US006302743B1

(12) United States Patent
Chiu et al.

(10) Patent No.: US 6,302,743 B1
(45) Date of Patent: Oct. 16, 2001

(54) ELECTRIC OUTLET ASSEMBLY WITH ROTARY RECEPTACLES

(76) Inventors: Pen-Li Chiu, 5F., No. 5, Lane 94, Chung Hsin Street, Taipei Hsien (TW); Pen-Fu Chiu, 6F., No. 9-1, Lane 7, Lane 270, Chung Pin Rd., Hsinchuan City (TW)

( * ) Notice: Subject to any disclaimer, the term of this patent is extended or adjusted under 35 U.S.C. 154(b) by 0 days.

(21) Appl. No.: 09/779,469

(22) Filed: Feb. 9, 2001

(51) Int. Cl.[7] ..... H01R 25/00
(52) U.S. Cl. ..... 439/652; 439/22; 439/687
(58) Field of Search ..... 439/652, 502, 439/20, 21, 22, 23, 24, 213, 214, 646, 680, 683, 949

(56) References Cited

U.S. PATENT DOCUMENTS 4,979,907 * 12/1990 Lee ..... 439/214
5,775,921 * 7/1998 Chou ..... 439/21
5,788,521 * 8/1998 Milan ..... 439/214
5,997,310 * 12/1999 Chiu et al. ..... 439/21
6,007,344 * 12/1999 Corrunker et al. ..... 430/22
6,045,399 * 4/2000 Yu ..... 439/502
6,048,211 * 4/2000 Liaom ..... 439/4
6,054,657 * 4/2000 Liao ..... 200/51.02
6,086,397 * 7/2000 Chapman et al. ..... 439/214

* cited by examiner

*Primary Examiner*—Tulsidas Patel
(74) *Attorney, Agent, or Firm*—Varndell & Varndnell, PLLC

(57) ABSTRACT

An electric outlet assembly having multiple receptacle and contact holder sets mounted in a bottom shell and a top cover shell and adapted to receive electric plugs, the receptacle and contact holder sets each including a contact holder mounted in the bottom shell, three annular metal contact plates concentrically mounted on the contact holder and respectively connected to respective metal contact strips in the bottom shell, and a rotary receptacle mounted in a respective hole on the top cover shell corresponding to the contact holder and rotatable relative to the contact holder, the rotary receptacle having three plug holes, and three metal contact terminals respectively mounted in the plug holes at a bottom side and disposed in contact with the annular contact plates, the metal contact terminals being maintained in contact with the annular metal contacts upon rotary motion of the rotary receptacle relative to the contact holder.

9 Claims, 7 Drawing Sheets

ELECTRIC OUTLET ASSEMBLY WITH ROTARY RECEPTACLES

BACKGROUND AND SUMMARY OF THE INVENTION

The present invention relates to electric outlets and, more particularly, to an electric outlet assembly, which comprises a plurality of rotary receptacles adapted to receive electric plugs in different directions Regular electric home appliances, such as refrigerator, washing machine, television, electric fan, electric hair dryer, and etc., must be connected to an electric outlet to obtain the necessary working voltage. Regular electric outlets include fixed type fixedly installed in the wall, and movable type equipped with an electric extension cable. An electric outlet with an electric extension cable has multiple receptacles, each receptacle having two or three plugholes for receiving the metal blades of an electric plug. Because the receptacles of an electric outlet are not rotatable, the installation direction of electric plugs is limited. When pulling the electric extension cable of an electric plug installed in one receptacle, the conductors of the electric extension cable or the connections between the conductors and respective metal blades of the electric plug may be broken. There is known an electric outlet means of which the receptacle means can be turned within 90° between the "on" position and the "of" position. This structure of electric outlet means does not eliminate the aforesaid drawbacks.

The present invention has been accomplished to provide an electric outlet assembly, which eliminates the aforesaid drawbacks. It is the main object of the present invention to provide an electric outlet assembly, which is equipped with rotary receptacles adapted to receive electric plugs in different directions. It is another object of the present invention to provide an electric outlet assembly, which prevent damage when the power cord of each electric plug installed therein is stretched. According to one aspect of the present invention, the electric outlet assembly comprises multiple receptacle and contact holder sets mounted in a housing formed of a bottom shell and a top cover shell and adapted to receive electric plugs, the receptacle and contact holder sets each comprising a contact holder mounted in the bottom shell, three annular metal contact plates concentrically mounted on the contact holder and respectively connected to respective metal contact strips in the bottom shell, and a rotary receptacle mounted in a respective hole on the top cover shell corresponding to the contact holder and rotatable relative to the contact holder, the rotary receptacle having three plug holes, and three metal contact terminals respectively mounted in the plug holes at a bottom side and disposed in contact with the annular contact plates, the metal contact terminals being maintained in contact with the annular metal contacts upon rotary motion of the rotary receptacle relative to the contact holder. According to another aspect of the present invention, the contact holder has three bottom positioning rods respectively inserted into a respective positioning hole on a respective locating block in the bottom shell, and compression springs are respectively mounted around the bottom positioning rods and supported on the locating blocks of the bottom shell to impart an upward pressure to the contact holder, keeping the annular contact plates of the contact holder in positive contact with the respective metal contact terminals of the rotary receptacle.

DETAILED DESCRIPTION OF THE PREFERRED EMBODIMENT

Figure 1:
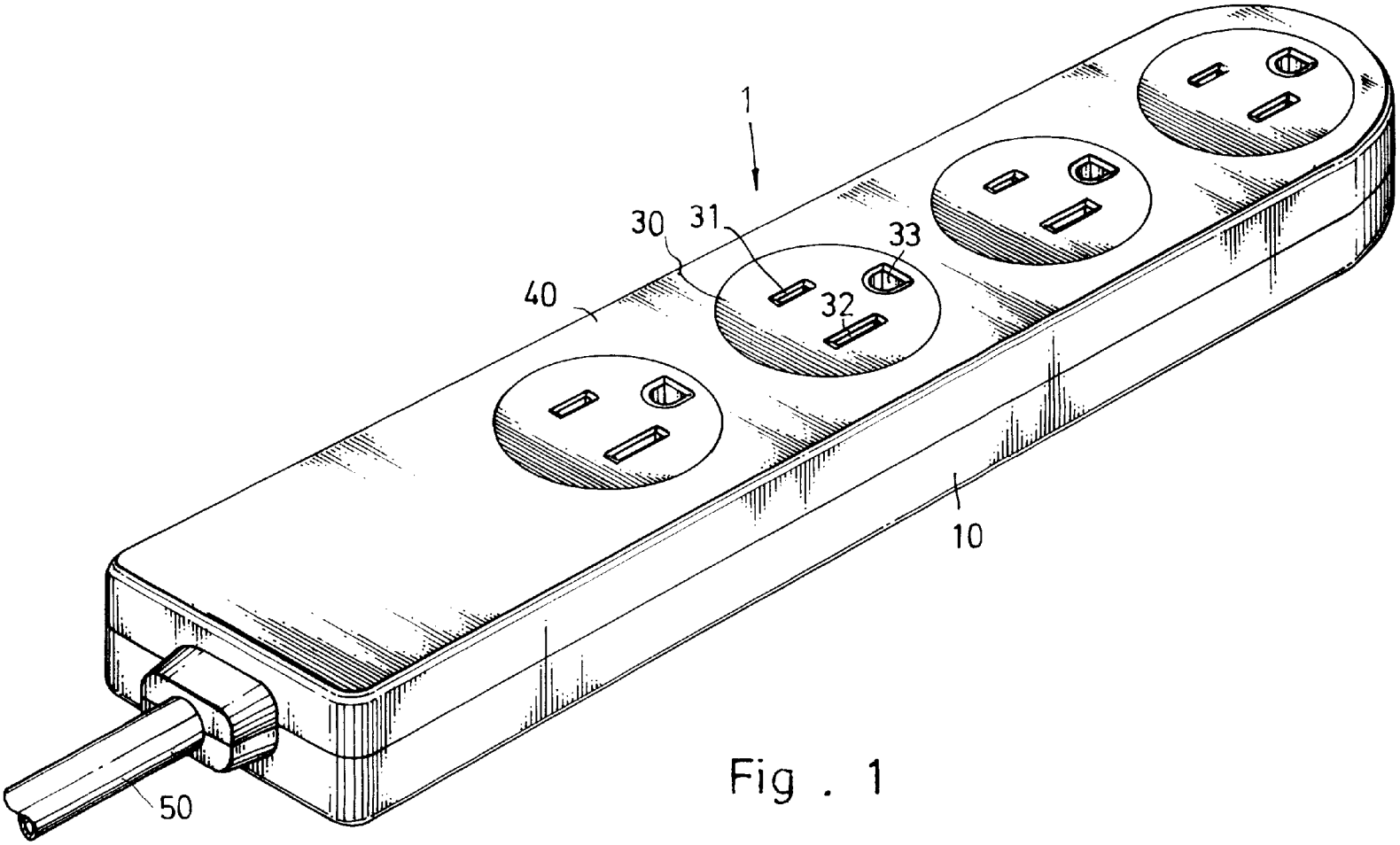
FIG. 1 is an elevational view of an electric outlet assembly according to the present invention.
Figure 2:
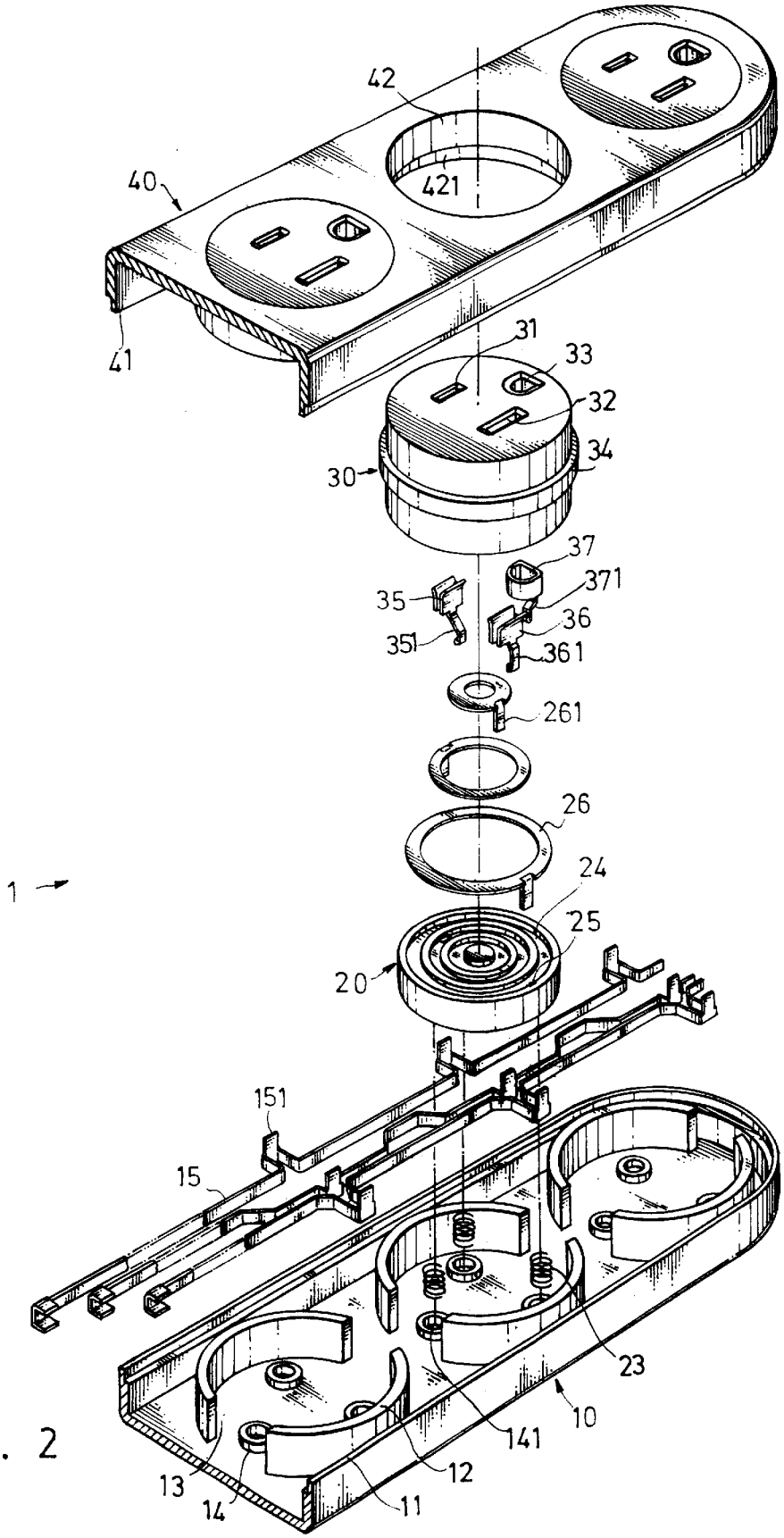
FIG. 2 is an exploded view of the electric outlet assembly according to the present invention.

Referring to FIGS. 1 and 2, an electric outlet assembly 1 is provided at one end of an electric extension cable 50. The electric outlet assembly 1 is comprised of a bottom shell 10, a plurality of contact holders 20, three metal contact strips 15, a plurality of rotary receptacles 30, and a top cover shell 40.

Referring to FIGS. From 3 through 5 and FIG. 2 again, the bottom shell 10 comprises a step-like upright peripheral wall 11, pairs of smoothly arched flanges 12 respectively disposed on the inside and defining a respective receiving open chamber 13, and three locating blocks 14 each respectively disposed in each receiving open chamber 13 defined within each pair of smoothly arched flanges 12. The locating blocks 14 each define a positioning hole 141. The metal contact strips 15 are respectively connected to the electric extension cable 50 and arranged in parallel in the bottom shell 10 and respectively inserted through the receiving open chambers 13 and separated from one another by the three locating blocks 14 in each receiving open chamber 13, each having a plurality of protruded contact portions 151 respectively suspended in the receiving open chambers 13. The contact holders 20 are respectively mounted in the receiving chambers 13 inside the bottom shell 10, each comprising three bottom positioning rods 21 respectively inserted into the positioning holes 141 of the locating blocks 14, three bottom annular grooves 22 respectively disposed at the bottom side wall thereof around the bottom positioning rods 21, three compression springs 23 respectively mounted in the annular grooves 22 to support the contact holders 20 on the locating blocks 14, three top annular grooves 24 concentrically disposed at the top side wall thereof, three plug holes 25 respectively disposed in the top annular grooves 24 and adapted to receive the protruded contact portions 151 of the metal contact strips 15, and three annular metal contact plates 26 respectively mounted in the top annular grooves 24. The annular metal contact plates 26 each have a downwardly protruded contact portion 261 respectively inserted into the plugholes 25 in the top annular grooves 24 and maintained in contact with the protruded contact portions 151 of the metal contact strips 15. The rotary receptacles 30 are cylindrical members respectively revolvably covered on the contact holders 20 in the receiving open chambers 13 inside the bottom shell 10, each comprising a peripheral flange 34 supported on one pair of smoothed arched flanges 12 of the bottom shell 10, a positive contact plug hole 31, a negative contact plug hole 32, a static contact plug hole 33, and three metal contact terminals, namely, the positive pole contact terminal 35, the negative pole contact terminal 36, and the static contact terminal 37 respectively fastened to the plug holes 31, 32 and 33 at the bottom side and disposed in contact with the annular metal contact plates 26. The positive pole contact terminal 35 and the negative pole contact terminal 36 each have a forked top end and a bottom contact tail 351 or 361. The static contact terminal 37 has a hollow, semicircular top end and a bottom contact tail 371. After installation, the contact tails 351, 361 and 371 are disposed in contact with the annular metal contact plates 26 of the corresponding contact holder 20. The top cover shell 40 comprises a step-like, downwardly extended peripheral wall 41 fitted over the step-like upright peripheral wall 11 of the bottom shell 10, a plurality of circular holes 42 adapted to receive the rotary receptacles 30, and a plurality of annular locating grooves 421 respectively disposed on the inside wall thereof around each circular hole 42 and adapted to receive the peripheral flange 34 of each rotary receptacle 30.

Figure 3:
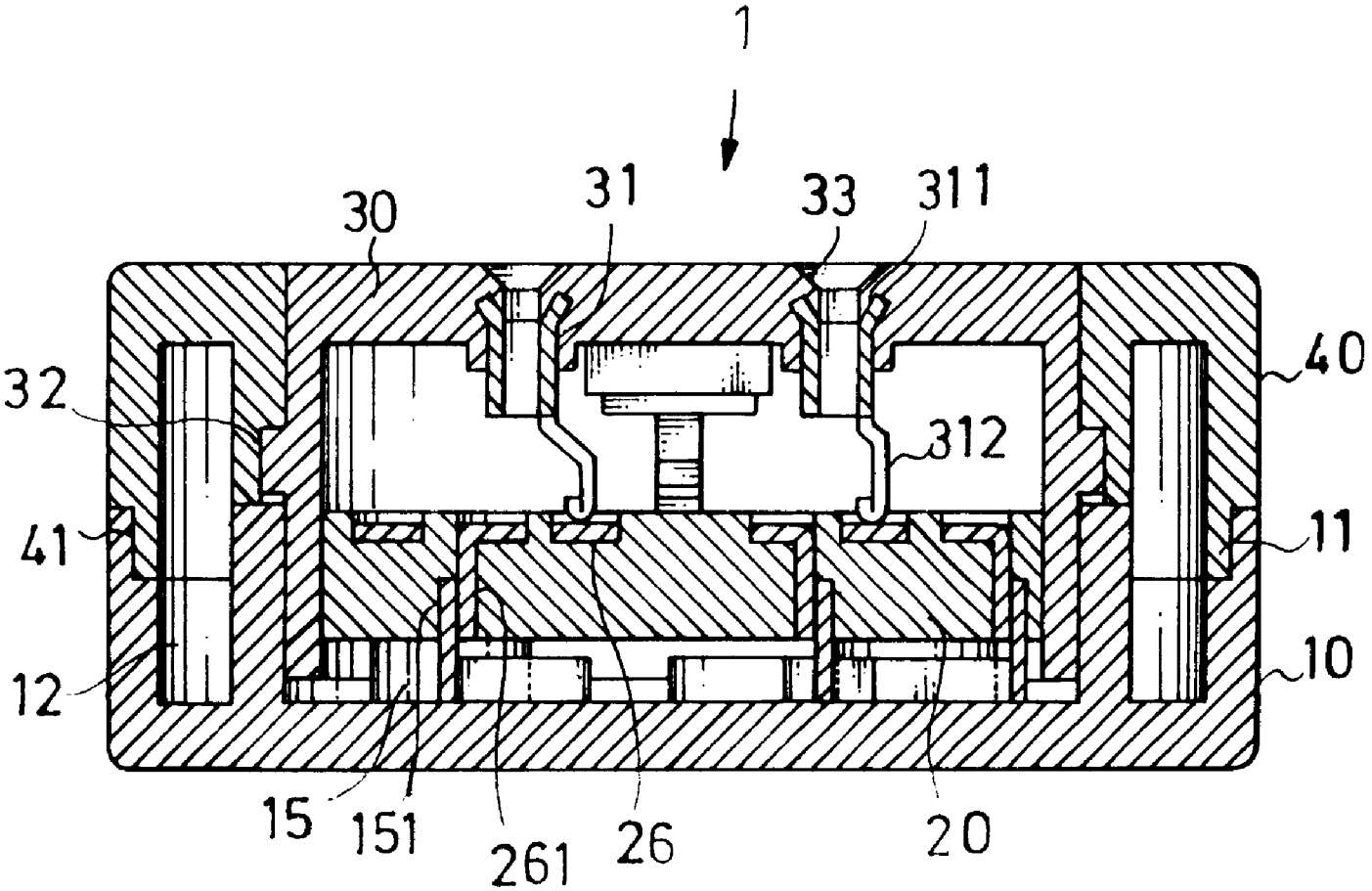
FIG. 3 is a longitudinal view in section of the electric outlet assembly according to the present invention.
Figure 4:
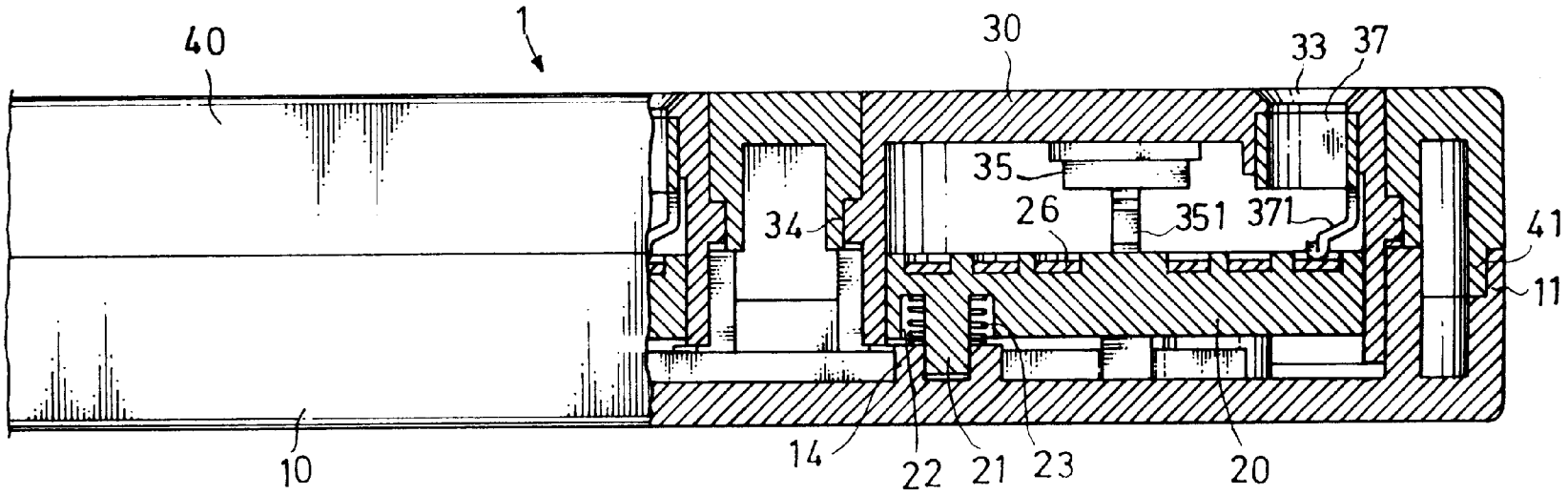
FIG. 4 is a transverse view in section of the electric outlet assembly according to the present invention.
Figure 5:
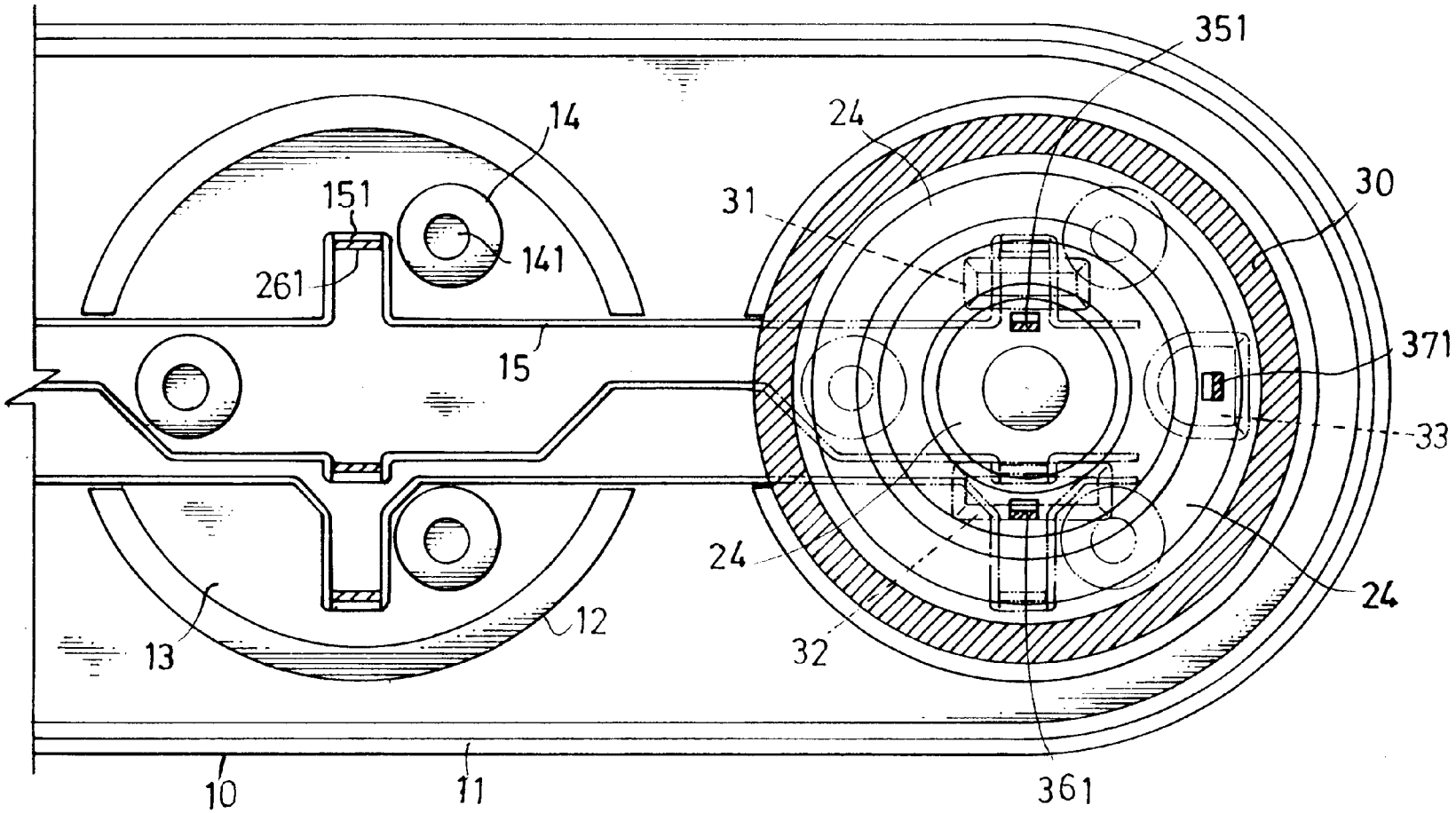
FIG. 5 is a top view, partially in section of the electric outlet assembly according to the present invention.

Referring to FIGS. 3 and 4 again, the peripheral flange 34 of the rotary receptacle 30 is positioned in the annular locating groove 421 around one circular hole 42 of the top cover shell 40 and supported on one pair of smoothly arched flanges 12 of the bottom shell 10, enabling the rotary receptacle 30 to be rotated in the corresponding circular hole 42 to the desired angle, the contact tails 351, 361 and 371 of the contact terminals 35, 36 and 37 are respectively maintained in contact with the annular metal contact plates 26 of the corresponding contact holder 20, and the downwardly protruded contact portions 261 of the metal contact plates 26 are respectively maintained in contact with the corresponding protruded contact portions 151 of the metal contact strips 15. Further, the compression springs 23 impart an upward pressure to the contact holder 20, forcing the 34 of the metal contact plates 26 into contact with the contact terminals 35, 36 and 37 respectively.

Figure 6:
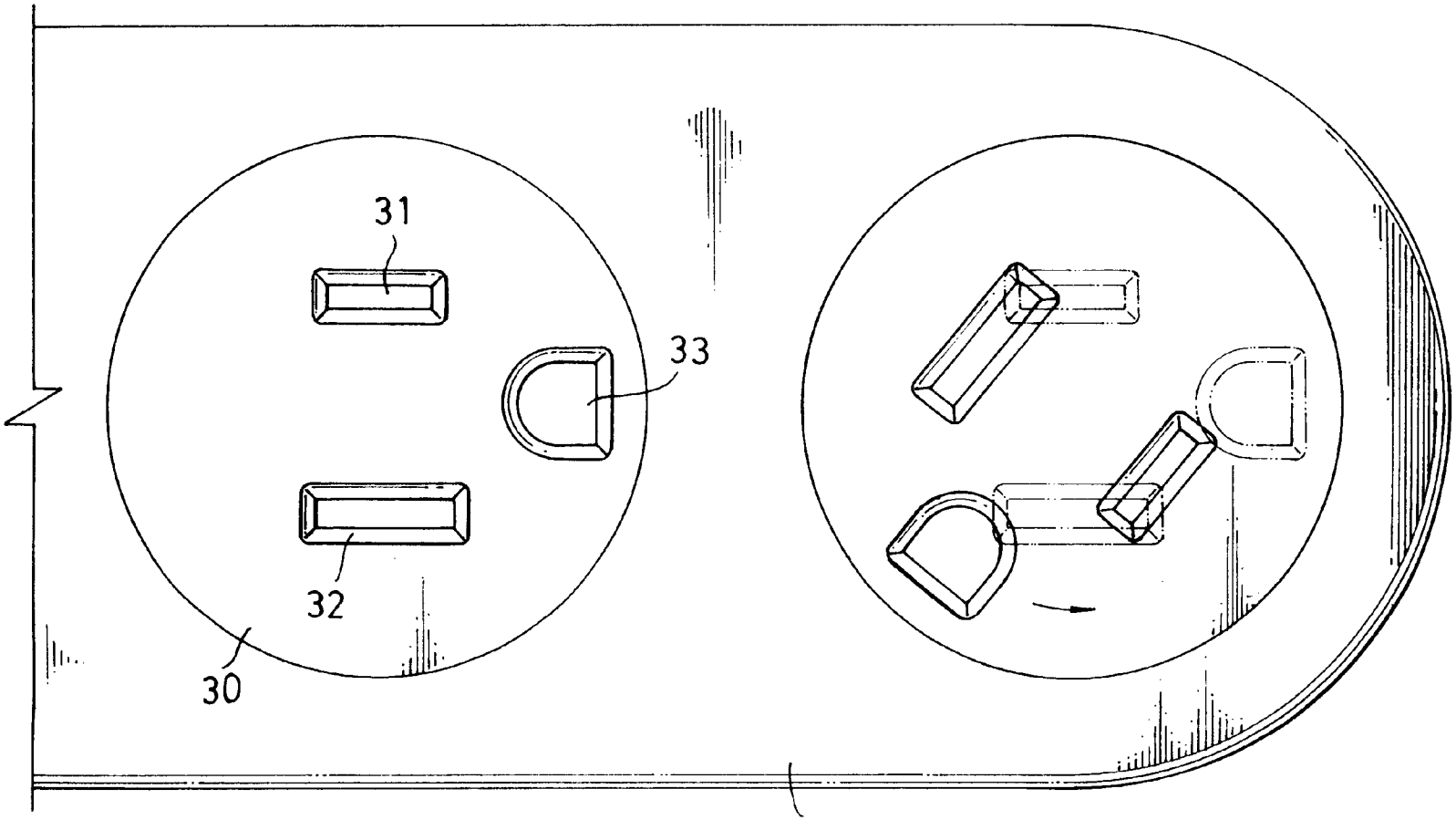
FIG. 6 is a plain view of the present invention showing one rotary receptacle rotated.

Referring to FIG. 6 and FIG. 1 again, as indicated above, the rotary receptacles 30 are revolvably supported in the bottom shell 10 and the top cover shell 40 and the contact terminals 35, 36 and 37 of the rotary receptacles 30 are respectively disposed in contact with the annular metal contact plates 26, the contact terminals 35, 36 and 37 are respectively constantly maintained electrically connected to the metal contact strips 15. After insertion of an electric plug in the plug holes 31, 32 and 33 of one rotary receptacle 30, the inserted electric plug is electrically connected to the electric outlet assembly 1 and, can be rotated with the rotary receptacle 30 through 360°. Therefore, when the power cord of the inserted electric plug is pulled in one direction, the electric plug and the rotary receptacle 30 are rotated to the direction of the pull force, preventing damage to the electric plug or the conductors of the power cord of the electric plug. Further, because the receptacles 30 can be rotated through 360°, the user can rotate the inserted electric plug to the desired angle.

Figure 7:
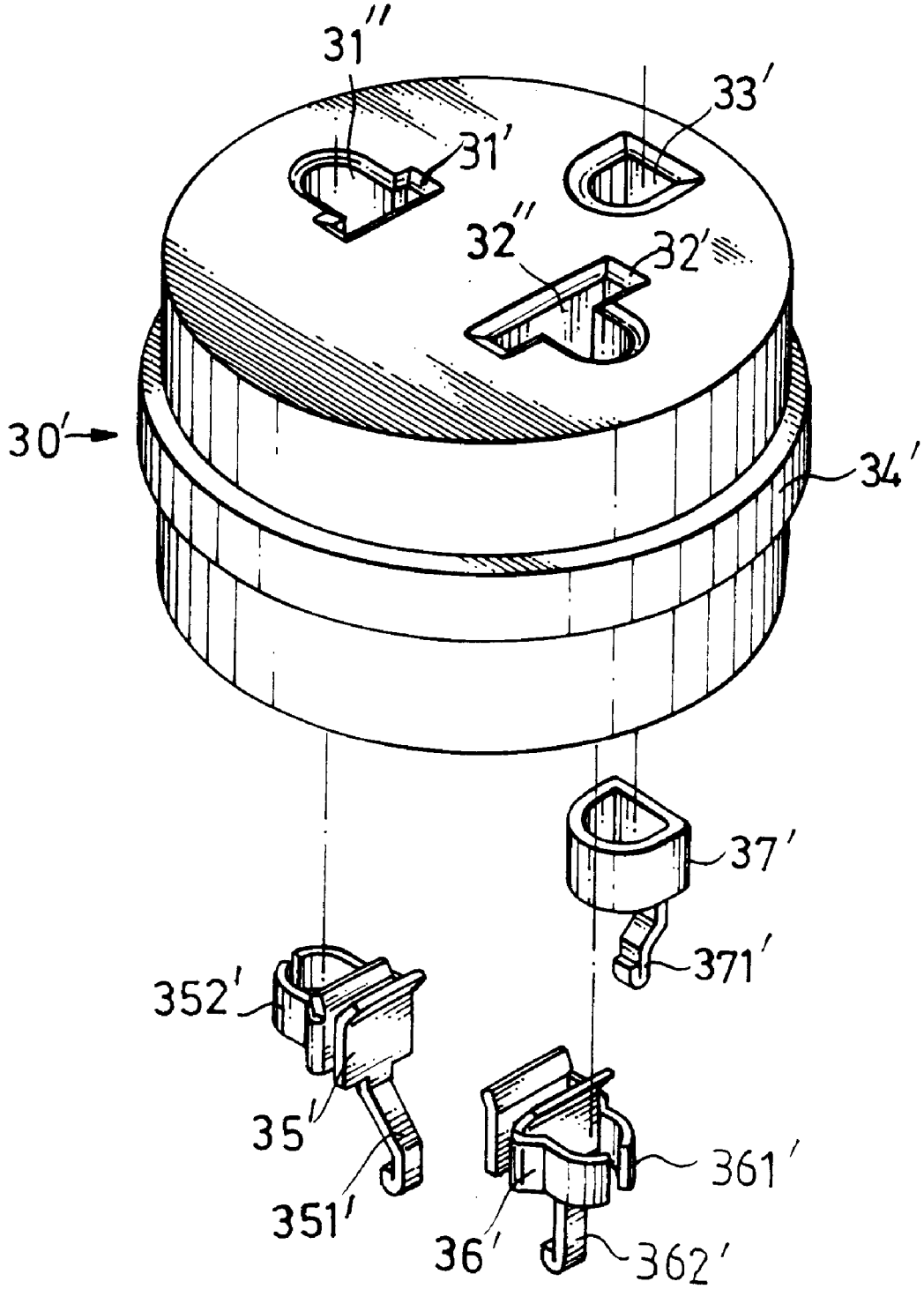
FIG. 7 is an exploded view of an alternate form of the rotary receptacle according to the present invention.

FIG. 7 shows an alternate form of the rotary receptacle 30' according to the present invention. According to this alternate form, the rotary receptacle 30' has semi-circular plug holes 31" and 32" respectively connected to the positive contact plug bole 31' and negative contact plug hole 32' at one side, and the positive pole contact terminal 35' and negative pole contact terminal 36' each have two arched protruding portions 352' or 362' disposed at one side of the respective forked top end and facing toward each other. This alternate form is adapted to receive the three metal round blades of an electric plug.

As indicated above, the present invention provides an electric outlet, which comprises a plurality of contact holders each holding three concentrically arranged annular metal contact plates, and a plurality of rotary receptacles each holding three metal contact terminals respectively constantly maintained in contact with the annular metal contact plates at one contact holder. Therefore, the rotary receptacles are maintained electrically connected when rotated. Because the rotary receptacles can be rotated through 360°, stretching the power cord of the electric plug installed in one rotary receptacle does not cause damage to the conductors or the electric plug, or connecting portions between the metal blades and conductors of the electric plug.

It is to be understood that the drawings are designed for purposes of illustration only, and are not intended for use as a definition of the limits and scope of the invention disclosed.

What is claimed is:

1. An electric outlet assembly comprising a bottom shell, a top cover shell covered on said bottom shell, an electric cable extended out of said bottom shell and said top cover shell at one side, three metal contact strips arranged in parallel in said bottom shell and connected to respective conductors in said electric extension cable, and a plurality of receptacle and contact holder sets installed in said top cover shell and electrically connected to said metal contact strips and adapted to receive electric plugs, wherein said receptacle and contact holder sets each comprise:

a contact holder mounted in said bottom shell;

three annular metal contact plates concentrically mounted on said contact holder and respectively connected to said metal contact strips; and a rotary receptacle mounted in a respective hole on said top cover shell corresponding to said contact holder and rotatable relative to said contact holder, said rotary receptacle comprising three plug holes, and three metal contact terminals respectively mounted in said plug holes at a bottom side and disposed in contact with said annular contact plates, said metal contact terminals being maintained in contact with said annular metal contacts upon rotary motion of said rotary receptacle relative to said contact holder.

2. The electric outlet assembly of claim 1, wherein said top cover shell comprises a step-like, downwardly extended peripheral wall coupled to said bottom shell, a plurality of circular holes adapted to receive the rotary receptacle of each of said receptacle and contact holder sets, and a plurality of annular locating grooves respectively disposed on an inside wall thereof around said circular holes for the positioning of a peripheral flange of the rotary receptacle of each of said receptacle and contact holder set.

3. The electric outlet assembly of claim 1, wherein said bottom shell comprises a step-like upright peripheral wall coupled to the step-like, downwardly extended peripheral wall of said top cover shell, pairs of smoothly arched flanges respectively disposed on the inside and defining a respective receiving open chamber adapted to receive the contact holder of each of said receptacle and contact holder sets and through which said metal contact strips pass, and three locating blocks each respectively disposed in the receiving open chamber defined within each pair of smoothly arched flanges, said locating blocks each defining a positioning hole for the positioning of the contact holder of one receptacle and contact holder set.

4. The electric outlet assembly of claim 3, wherein said metal contact strips are extended through the receiving open chambers defined in said smoothly arched flanges and separated from one another by said locating blocks, each comprising a plurality of protruded contact portions respectively disposed in contact with the contact terminals of the rotary receptacle of each of said receptacle and contact holder sets.

5. The electric outlet assembly of claim 2, wherein the rotary receptacle of each of said receptacle and contact holder sets is a cylindrical member mounted in one circular hole of said top cover shell, having a peripheral flange coupled to the annular locating groove on the inside wall of said top cover shell around the corresponding circular hole of said top cover shell.

6. The electric outlet assembly of claim 1, wherein the plug holes of the rotary receptacle of each of said receptacle and contact holder sets are adapted to receive an electric plug having two flat metal blades and a round grounding prong, and the three metal contact terminals of the rotary receptacle of each of said receptacle and contact holder sets include a positive pole contact terminal, a negative pole contact terminal, and a static contact terminal, said positive pole contact terminal and said negative pole contact terminal each having a forked top end adapted to receive one flat metal blade of an electric plug and a bottom contact tail disposed in contact with one annular metal contact plate, said static contact terminal having a hollow, semicircular top end adapted to receive the round grounding prong of an electric plug and a bottom contact tail disposed in contact with one annular metal contact plate.

7. The electric outlet assembly of claim 1, wherein the plug holes of the rotary receptacle of each of said receptacle and contact holder sets are adapted to receive an electric plug having three round metal blades, and the three metal contact terminals of the rotary receptacle of each of said receptacle and contact holder sets each have a top receiving end adapted to receive the three round metal blades of an electric plug and a bottom contact tail disposed in contact with one annular metal contact plate.

8. The electric outlet assembly of claim 1, wherein the contact holder of each of said receptacle and contact holder sets comprises three bottom positioning rods respectively inserted into the positioning holes of the locating blocks in the corresponding receiving open chamber in said bottom shell, three bottom annular grooves respectively disposed at a bottom side wall thereof around said bottom positioning rods, and three compression springs respectively mounted in said bottom annular grooves around said bottom positioning rods and supported on the locating blocks in the corresponding receiving open chamber.

9. The electric outlet assembly of claim 1, wherein the contact holder of each of said receptacle and contact holder sets comprises three top annular grooves concentrically disposed at atop side wall thereof and three plug holes respectively disposed in said top annular grooves; the three annular metal contact plates of each of said receptacle and contact holder sets are respectively mounted in the three top annular grooves of the corresponding contact holder, each having a downwardly protruded contact portion inserted into one plug hole of the corresponding contact holder and maintained in contact with one protruded contact portion of one metal contact strip in said bottom shell.

* * * * *